US006818323B2

(12) United States Patent
Fu et al.

(10) Patent No.: US 6,818,323 B2
(45) Date of Patent: Nov. 16, 2004

(54) THIN FILM ALLOY MATERIAL WITH THE DESIGN OF OPTIC REFLECTION AND SEMI-TRANSMISSION

(75) Inventors: Cheng-Yang Fu, TaoYuan (TW); Cherng-Yuh Su, ChangHua (TW)

(73) Assignee: Homogeneity Electronic Material Co., Ltd., TaoYuan Hsien (TW)

( * ) Notice: Subject to any disclaimer, the term of this patent is extended or adjusted under 35 U.S.C. 154(b) by 0 days.

(21) Appl. No.: 10/435,540

(22) Filed: May 12, 2003

(65) Prior Publication Data

US 2003/0215666 A1 Nov. 20, 2003

(30) Foreign Application Priority Data

May 14, 2002 (TW) ..... 91109959 A

(51) Int. Cl.[7] ..... B32B 15/00; B32B 15/04; B32B 15/20; G11B 3/70

(52) U.S. Cl. ..... 428/673; 428/674; 428/687; 428/694 RL; 428/64.4; 360/131; 369/288

(58) Field of Search ..... 428/674, 673, 428/660, 687, 694 RL, 694 TR, 694 TP, 64.4, 412; 369/288; 360/131

(56) References Cited

U.S. PATENT DOCUMENTS 6,391,462 B1 * 5/2002 Jang ..... 428/432
6,544,616 B2 * 4/2003 Nee ..... 428/64.1
2002/0192424 A1 * 12/2002 Ohkubo ..... 428/64.4
2003/0227250 A1 * 12/2003 Nee ..... 313/495

* cited by examiner

*Primary Examiner*—Michael La Villa
(74) *Attorney, Agent, or Firm*—Troxell Law Office PLLC

(57) ABSTRACT

A thin film alloy material with the design of optic reflection and semi-transmission, which not only can make a single layer film have the effect of reflection and semi-transmission simultaneously, but also can attain the effect that has different reflectivity and half-transmittance by adjusting the ratio of alloy and the thickness of thin film. In a thin film that has relative upper and lower surfaces, there are a first alloy layer and a second alloy layer coated on the upper and lower surface; wherein the first alloy layer is composed of silver and metal X, and the metal X is chosen from one of the following metals: titanium, zirconium, hafnium; the second alloy layer is composed of silver, copper, and metal X, and the metal X is chosen from one of the following metals: titanium, zirconium, hafnium.

10 Claims, 3 Drawing Sheets

THIN FILM ALLOY MATERIAL WITH THE DESIGN OF OPTIC REFLECTION AND SEMI-TRANSMISSION

FIELD OF THE INVENTION

The invention relates to a thin film alloy material with the design of optic reflection and semi-transmission. In particular, the invention relates to a single layer thin film alloy material, which has tie effect of reflection and semi-transmission simultaneously, and can attain different reflectivity and half-transmittance by adjusting the ratio of alloy as well as the thickness of thin film.

BACKGROUND OF THE INVENTION

Along with the great stride of electric technology, photoelectric industry, such as CD industry and flat panel display industry etc. developed a great deal of consumption products, in which metal reflective film plays the necessary role. The characters of metal reflective film such as reflection, half-reflection, beam-split, light filtering etc. can be used to design different optic devices.

In the reflection process of CD, a laser beam with high resolution transmits the polycarbonate substrate, reaching to the reflective layer, on which the beam focuses on the information pits so as to read the disc. The laser beam moves along with the tracks on CD, focusing on the alternately pits and planes to generate destructive interference as well as constructive interference, and then forms the digital signal "1" or "0", which can be shown as music or computer program after electric decoding.

Generally, the higher conductive coefficient of metal is, the higher reflectivity will be. So most metal reflective materials are the high conductivity materials such as Au, Ag, Al, and Cu etc. In general, the reflection layer of the disc is placed on the plane that has pits and can transmit information. The mast common materials of it are aluminum or aluminum alloy (such aluminum-zirconium alloy); moreover, in flat panel displays (such as TFT-LCD, PDP, OLED), aluminum alloy (such as aluminum-neodymium alloy) is also a necessary material of conductive film.

Recently, the era of DVD that has high capacity, high audio quality, and high-definition is coming. Many thin films of different functions in DVD disk are formed with certain target materials by such as sputtering method. Wherein there are two information film layers in the double-side-single-layer DVD disk played with one side. The first layer is a high reflection layer, i.e. a common total reflection layer, and the second layer is a half-reflection layer, of which the reflectivity is among 18~30%. Besides reflecting light, the second layer also needs to be transmitted by substantial light beam so that the laser can access to the high reflection layer and return to the signal detector though the half-reflection layer.

The common materials of half-reflection layer are pure gold is and silicon. Gold can reflect light and can be transmitted by light; moreover, it has better character of anti-corrosion and is easier to form a uniform film by sputtering, but it is very expansive. Silicon also has drawbacks such as that its deposition rate and deposition amount is less than gold and that it easily reacts with oxygen and nitrogen. So in the past few years, the whole world has enthusiastically researched the ingredient and the fabrication process of new materials. FIG. 1 is a schematic diagram of the multi-layer thin film material with the design of reflection and half-reflection of the prior art, which mainly comprises: a transparent substrate 120, a half-reflection layer 130 that has the first pit pattern 115, a transparent interval layer 125, and a high reflection layer 135 that has the second pit pattern 105. When the light beam from laser 140 indicates to substrate 120, reflected by half-reflection layer 130 and high reflection layer 135, it will be eventually detected by the photodetector 145 that can sense the modulation of light intensity based on whether there is a pit on a certain point of the reflection layer.

However; in such structure of prior art, both the half-reflection film and high reflection film must be coated on the substrate as a multi-layer thin film structure. For the CD manufacturers, the complicated structure and fabrication process are so burdensome that the cost cannot be reduced, delaying the technology.

SUMMARY OF THE INVENTION

The major objective of the present invention is to provide a thin film alloy material with the design of optic reflection and semi-transmission, which can attain the effect of reflection and semi-transmission simultaneously.

Another objective of the present invention is to provide a thin film alloy material with the design of optic reflection and semi-transmission, which can be coated on the both sides of a single layer film to from total reflection layer and semi-transmission simultaneously.

The other objective of the present invention is to provide a thin film alloy material with the design of optic reflection and semi-transmission, which not only can make a single layer film have the effect of reflection and semi-transmission simultaneously, but also can attain the effect that has different reflectivity and half-transmittance by adjusting the ratio of alloy and the thickness of thin film.

To attain the foregoing object, the present invention provides a thin film alloy material with the design of optic reflection as well as semi-transmission, and a thin film that has top and bottom two sides, on which there are the first alloy layer and the second alloy layer coated. Wherein:

The first metal alloy layer is composed of silver (Ag) and metal X, and wherein the metal X is chosen from one of the following metals: titanium (Ti), zirconium (Zr), hafnium (Hf);

The second metal alloy layer is composed of silver (Ag), copper (Cu), and metal X, and wherein the metal X is chosen from one of the following metals: titanium (Ti), zirconium (Zr), hafnium (Hf);

It is preferable that the content of metal X accounts for 0.01%~10% of the first metal alloy layer, and the content of metal X accounts for 0.01%~10% of the second metal alloy layer.

For your esteemed reviewing committee members to further recognize and understand the invention in more complete way, a detailed description of the invention in matching with corresponding drawings are presented as following and hope they will benefit your esteemed reviewing committee members in reviewing this patent application favorably.

DETAILED DESCRIPTION OF THE INVENTION

Figure 1:
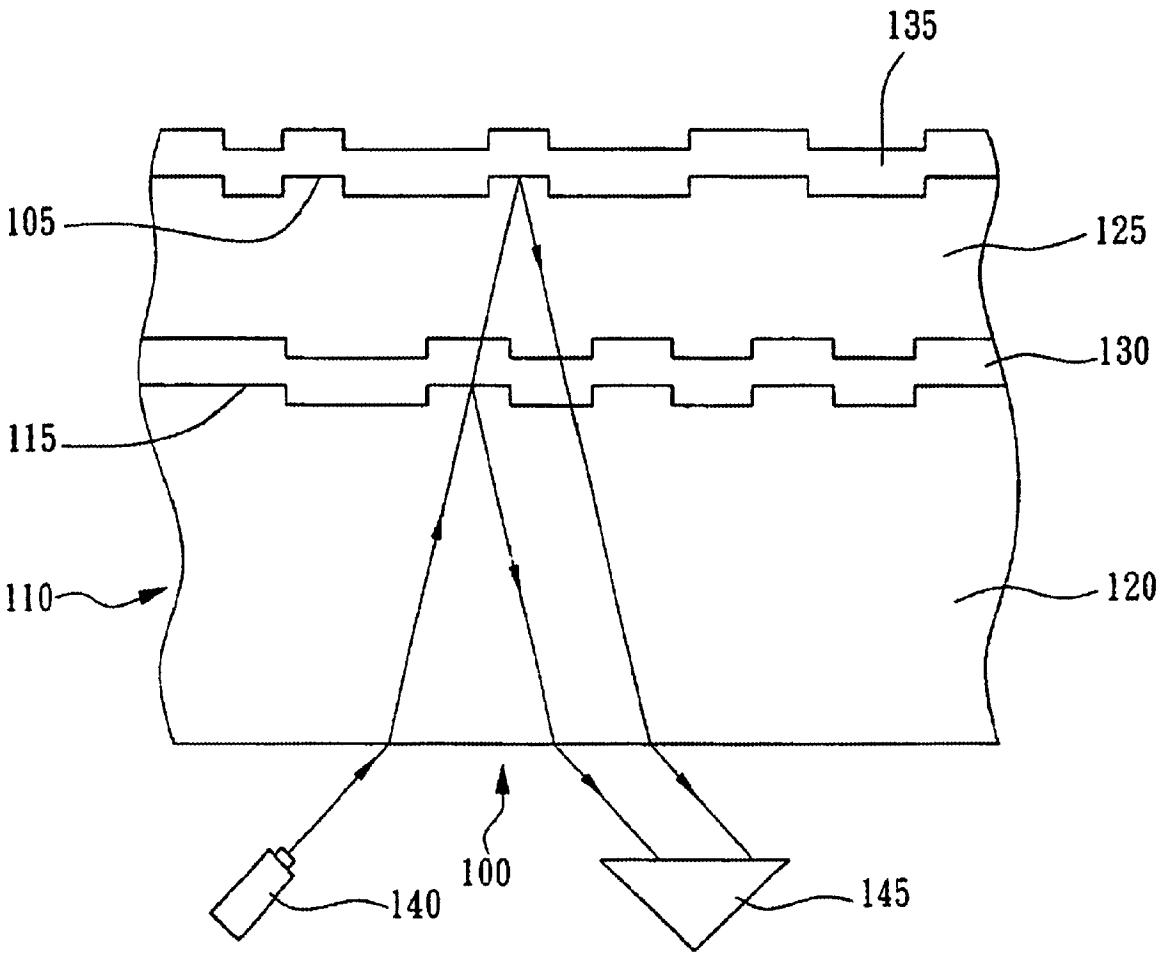
FIG. 1 (PRIOR ART)
FIG. 1 is a schematic drawing of the multi-layer thin film material with the design of optic reflection and semi-transmission in prior art.
Figure 2:
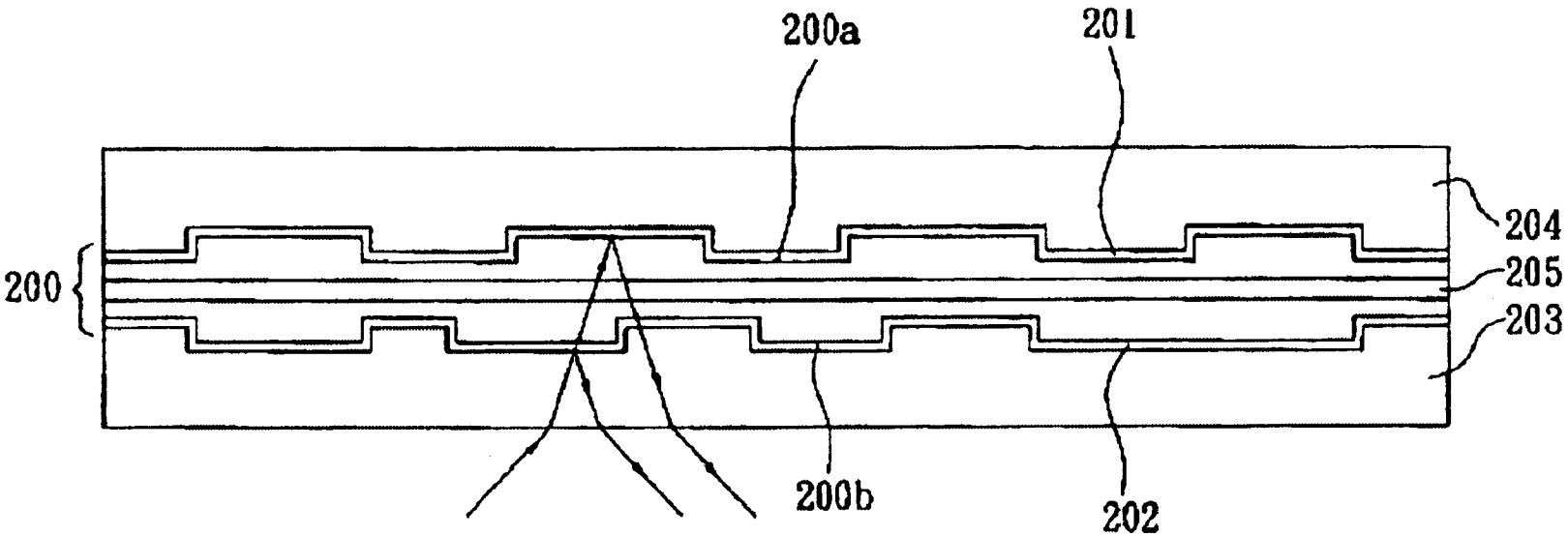
FIG. 2 is a schematic drawing of the thin film alloy material with the design of optic reflection and semi-transmission in a preferable embodiment of the present invention.

The present invention is to provide a thin film alloy material with the design of optic reflection and semi-transmission, solving the problem that it must use the multi-layer structure to form the CD with reflection film and half-reflection film simultaneously. FIG. 2 is a preferable embodiment of the thin film alloy material with the design of optic reflection and semi-transmission in the present invention, which mainly includes: a substrate 203, a thin film 200 that has relatively upper and lower surfaces 200*a*, 200*b*, and a upper cover layer 204.

The substrate 203 is a common material such as polycarbonate or transparent substrate; in the middle of the thin film 200 is a record film layer 205, which has the characters of wet-fastness and preventing hot deformation, moreover it needs to be changeable with the thermal condition when recording.

The technology character of the present invention is to coat a first alloy layer 201 and a second alloy layer 202 onto the upper and lower surfaces 200*a*, 200*b* of the thin film 200. The first metal alloy layer is composed of silver (Ag) and metal X, and wherein the metal X is chosen from one of the following metals: titanium (Ti), zirconium (Zr), hafnium (Hf); wherein the content of metal X accounts for 0.01%~10% of the first metal alloy layer, and it is preferable that the content of metal X accounts for 0.01%~5%. The second metal alloy layer is composed of silver (Ag) copper (Cu), and metal X, and wherein the metal X is chosen from one of the following metals: titanium (Ti), zirconium (Zr), hafnium (Hf); wherein the content of copper accounts for 0.01%~10% of the second metal alloy layer, and it is preferable that the content of copper accounts for 0.01%~8%; moreover, the content of metal X accounts for 0.01%~10% of the second metal alloy layer, and it is preferable that the content of metal X accounts for 0.01%~5%. The thickness of the thin film 200 is among 10 nm~200 nm.

The first alloy layer 201 is a total reflection thin layer (or called high reflection layer); and the second alloy layer 202 is a semi-transmission thin layer (or called half-reflection layer). When the light beam from laser is transmitted into substrate 203, it will transmit partially and be reflected partially by the second alloy layer 202, and be reflected by the first alloy layer 201, eventually detected by a photodetector (not shown in the figuration). Based on whether there is a pit on a certain point, the photodetector can sense the modulation of light intensity, and thus the thin film alloy material of the present invention can attain the effect of reflection and semi-transmission simultaneously.

Figure 3:
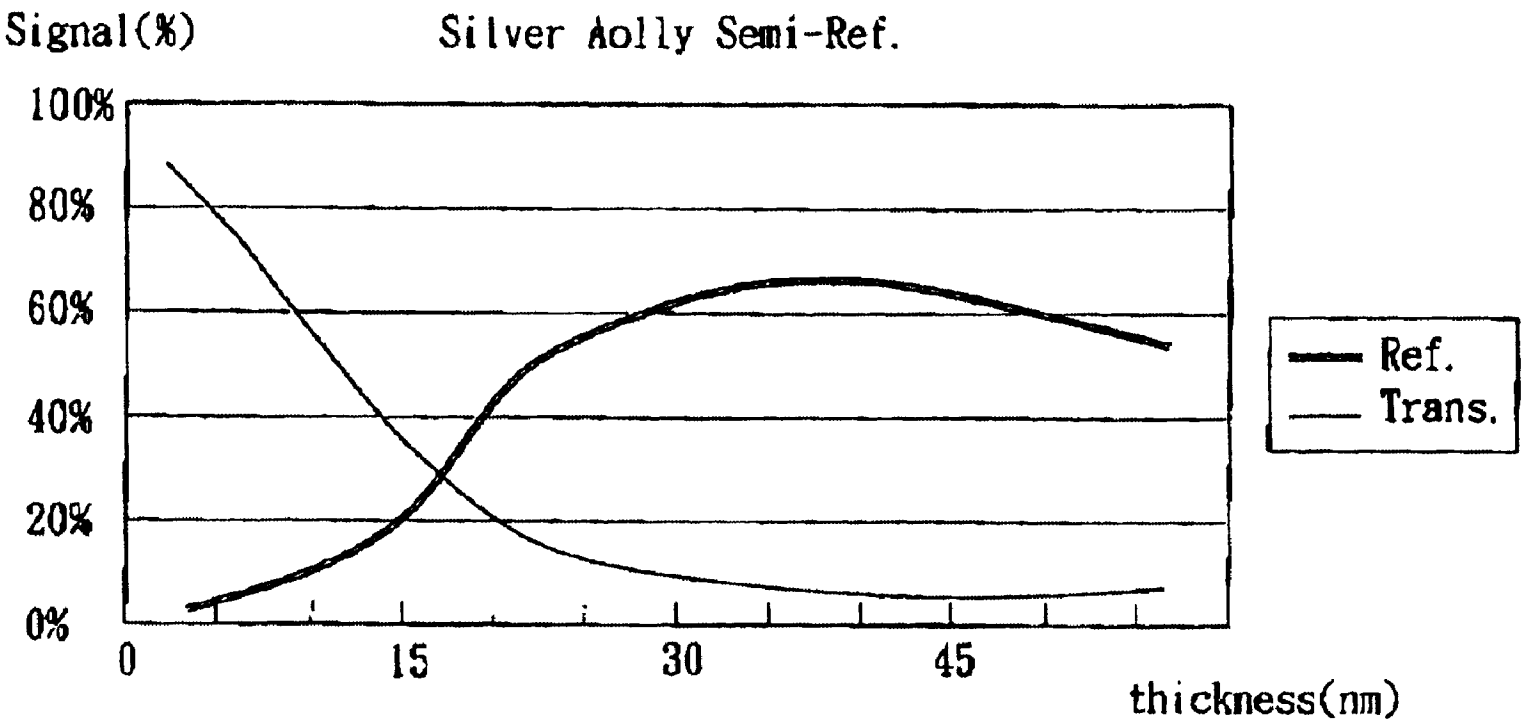
FIG. 3 is a schematic diagram that silver alloy has different reflectivity and transmittance at different thickness.

Certainly, the reflectivity and half-reflectivity of the above-mentioned first and second alloy layers 201, 202 can be varied among a certain range by adjusting the ratio of metal; moreover, it also can get the same effect forming different alloy layer thickness on the premise that the alloy ratio is fixed, FIG. 3 is the schematic diagram that silver alloy has different reflectivity and transmittance at different thickness, and it can be used to design an alloy layer with appropriate thickness to attain the effect of total-reflection or get the appropriate half-reflectivity. Such technology can largely raise the autonomy and creativeness of CD industry, making CD industry get more benefit and competitiveness.

The design and description of the present invention are illustrated in the preferable embodiment as above, and wherein the formation methods of the alloy layers include evaporation, sputtering, or ion plating etc.

Besides the above-mentioned CD industry (such as DVD), the present invention can be applied to LCD, big size glass, and PDA etc. industries. Moreover, the above description is only the preferable embodiment of the invention and cannot be used as a limitation for the scope of implementation of the invention. Any variation and modification made from the scopes claimed from the invention all should be included within the scope of the present invention.

In summary, from the structural characteristics and detailed disclosure of each embodiment according to the invention, it sufficiently shows that the invention has progressiveness of deep implementation in both objective and function, also has the application value in industry, and it is an application never seen ever in current market and, according to the spirit of patent law, the invention is completely fulfilled the essential requirement of new typed patent.

What is claimed is:

1. A thin film alloy material with the design of optic reflection and semi-transmission comprises:

a transparent film with relative upper and lower surfaces;

a first alloy layer and a second alloy layer coated on the upper and the lower surface of the transparent film respectively;

wherein the first metal alloy layer is composed of silver (Ag) and metal X, and the metal X is chosen from one of the following metals: titanium (Ti), zirconium (Zr), hafnium (Hf); the second metal alloy layer is composed of silver (Ag), copper (Cu), and metal Y, and the metal Y is chosen from one of the following metals: titanium (Ti), zirconium (Zr), and hafnium (Hf).

2. The thin film alloy material with the design of optic reflection and semi-transmission as recited in claim 1, wherein the transparent film further comprises record film layer located in the middle thereof.

3. The thin film alloy material with the design of optic reflection and semi-transmission as recited in claim 1, wherein the content of metal X accounts for 0.01 wt. %~10 wt. % of the first metal alloy layer.

4. The thin film alloy material with the design of optic reflection and semi-transmission as recited in claim 1, wherein the content of metal X accounts for 0.01 wt. %~5 wt. % of the first metal alloy layer.

5. The thin film alloy material with the design of optic reflection and semi-transmission as recited in claim 1, wherein the content of metal Y accounts for 0.01 wt. %~10 wt. % of the second metal alloy layer.

6. The thin film alloy material with the design of optic reflection and semi-transmission as recited in claim 1, wherein the content of metal Y accounts for 0.01 wt. %~5 wt. % of the second metal alloy layer.

7. A thin film alloy material with the design of optic reflection and semi-transmission comprises:

a transparent film with relative upper and lower surfaces, including a record film located in the middle thereof;

a first alloy layer and a second alloy layer coated on the upper and the lower surface of the transparent film respectively;

wherein the first metal alloy layer is composed of silver (Ag) and metal X, and the metal X is chosen from one of the following metals: titanium (Ti), zirconium (Zr), and hafnium (Hf); moreover, the content of metal X accounts for 0.01 wt. %~10 wt. % of the first metal alloy layer; the second metal alloy layer is composed of silver (Ag), copper (Cu), and metal Y, and the metal Y is chosen from one of the following metals: titanium (Ti), zirconium (Zr), and hafnium (Hf); moreover, the content of metal Y accounts for 0.01 wt. % ~10 wt. % of the second metal alloy layer.

8. The thin film alloy material with the design of optic reflection and semi-transmission as recited in claim 7, wherein the content of metal X accounts for 0.01 wt. %~5 wt. % of the first metal alloy layer.

9. The thin film alloy material with the design of optic reflection and semi-transmission as recited in claim 7, wherein the content of metal Y accounts for 0.01 wt. %~5 wt. % of the second metal alloy layer.

10. The thin film alloy material with the design of optic reflection and semi-transmission as recited in claim 7, wherein the content of copper accounts for 0.01 wt%~8 wt. % of the second metal alloy layer.

* * * * *